US008490437B2

(12) United States Patent
Kawabata et al.

(10) Patent No.: US 8,490,437 B2
(45) Date of Patent: Jul. 23, 2013

(54) DRUM TYPE WASHING-DRYING MACHINE

(75) Inventors: Shinichiro Kawabata, Seto (JP); Masatsugu Wada, Seto (JP); Hisao Tatsumi, Nagoya-chi (JP); Koji Kashima, Seto (JP)

(73) Assignees: Kabushiki Kaisha Toshiba, Tokyo (JP); Toshiba Ha Products Co., Ltd., Osaka (JP); Toshiba Consumer Marketing Corporation, Tokyo (JP)

( * ) Notice: Subject to any disclaimer, the term of this patent is extended or adjusted under 35 U.S.C. 154(b) by 1034 days.

(21) Appl. No.: 11/816,568

(22) PCT Filed: Jan. 26, 2006

(86) PCT No.: PCT/JP2006/301224

§ 371 (c)(1),
(2), (4) Date: Feb. 11, 2009

(87) PCT Pub. No.: WO2006/090552

PCT Pub. Date: Aug. 31, 2006

(65) Prior Publication Data

US 2009/0211309 A1 Aug. 27, 2009

(30) Foreign Application Priority Data

Feb. 22, 2005 (JP) ..... 2005-045612

(51) Int. Cl.
*D06F 37/00* (2006.01)
*B08B 3/12* (2006.01)

(52) U.S. Cl.
USPC ..... 68/3 R

(58) Field of Classification Search
None
See application file for complete search history.

(56) References Cited

U.S. PATENT DOCUMENTS

| | | | |
|---|---|---|---|
| 2,627,669 | A | 2/1953 | Candor |
| 3,691,649 | A | 9/1972 | Pigors |
| 3,805,404 | A | 4/1974 | Gould |
| 4,891,892 | A | 1/1990 | Narang |
| 5,042,171 | A | 8/1991 | Obata |

(Continued)

FOREIGN PATENT DOCUMENTS

| | | |
|---|---|---|
| CN | 1231357 | 10/1999 |
| CN | 1497091 A | 5/2004 |

(Continued)

OTHER PUBLICATIONS

English Language Abstract of JP 10-071292 published Mar. 17, 1998.

(Continued)

*Primary Examiner* — Michael Barr
*Assistant Examiner* — Jason Ko
(74) *Attorney, Agent, or Firm* — DLA Piper LLP (US)

(57) ABSTRACT

A drum type washing-drying machine includes an air supply opening and an air discharge opening both located in a water tub, a circulation path having both ends connected to the air supply opening and the air discharge opening respectively, and branch paths located between a part of the circulation path where the condenser is located and the air supply opening and/or extending in another part of the circulation path between the evaporator and the air discharge opening. Either air supply or discharge opening is located in an upper part of the water tub front. The circulation path includes a heat exchange section where a condenser and an evaporator are disposed so as to be located below the water tub. The branch paths extend from either air supply or air discharge opening, through a periphery of the opening of the water tub front to the heat exchange section.

2 Claims, 8 Drawing Sheets

U.S. PATENT DOCUMENTS

| | | | |
|---|---|---|---|
| 6,282,928 | B1 | 9/2001 | Fukumoto et al. |
| 6,378,341 | B1 | 4/2002 | Wiemer et al. |
| 6,748,772 | B2 | 6/2004 | Lee |
| 6,966,124 | B2 | 11/2005 | Ryu |
| 7,024,795 | B2 | 4/2006 | Tadano |
| 7,296,443 | B2 | 11/2007 | Usherovich et al. |
| 7,520,145 | B2 | 4/2009 | Hong |
| 7,814,770 | B2 | 10/2010 | Jeon |
| 7,866,061 | B2 | 1/2011 | Tatsumi |
| 2003/0056393 | A1 | 3/2003 | Lee |
| 2004/0079121 | A1 | 4/2004 | Yabuuchi et al. |
| 2005/0246920 | A1 | 11/2005 | Yabuuchi et al. |
| 2010/0024239 | A1 | 2/2010 | Kono |
| 2010/0107703 | A1 | 5/2010 | Hisano et al. |

FOREIGN PATENT DOCUMENTS

| | | | |
|---|---|---|---|
| DE | 10255575 | | 12/2003 |
| DE | 69922864 | | 6/2005 |
| EP | 0911438 | | 4/1999 |
| EP | 0942093 | A1 | 9/1999 |
| EP | 1197592 | | 4/2002 |
| EP | 1411163 | A2 | 4/2004 |
| EP | 1411163 | A3 | 4/2004 |
| JP | 47-8921 | | 4/1972 |
| JP | 48-12593 | B1 | 4/1973 |
| JP | A-S63-183095 | | 7/1988 |
| JP | H02-148697 | | 12/1990 |
| JP | H06-335599 | | 12/1994 |
| JP | 10-071292 | | 3/1998 |
| JP | H11-114273 | | 4/1999 |
| JP | 2000-225286 | | 8/2000 |
| JP | A-2004-135715 | | 5/2004 |
| JP | A-2004-135755 | | 5/2004 |
| JP | A-2004-337519 | | 12/2004 |
| JP | 2005-27734 | A | 2/2005 |
| JP | 2005-034163 | | 2/2005 |
| JP | 2005-46414 | | 2/2005 |
| JP | A-2005-27768 | | 2/2005 |
| JP | 2005-052533 | | 3/2005 |
| JP | 2005-052534 | | 3/2005 |
| JP | 2005-137646 | | 6/2005 |
| JP | 2005-224414 | A | 8/2005 |
| JP | 2005-318917 | A | 11/2005 |
| JP | 2006-015118 | | 1/2006 |
| JP | 2006-122466 | | 5/2006 |
| JP | 2006-314839 | | 11/2006 |
| JP | 2006-314840 | | 11/2006 |
| KR | 2004-0100894 | | 12/2004 |
| WO | WO 03/057968 | | 7/2003 |

OTHER PUBLICATIONS

English Language Translation of JP 10-071292 published Mar. 17, 1998.
English Language Abstract of JP 2005-137646 published on Jun. 2, 2005.
English Language Translation of JP 2005-137646 published on Jun. 2, 2005.
English Language Abstract of JP 2006-015118 published on Jan. 19, 2006.
English Language Translation of JP 2006-015118 published on Jan. 19, 2006.
English Language Abstract of JP 2006-122466 published on May 18, 2006.
English Language Translation of JP 2006-122466 published on May 18, 2006.
English Language Abstract of JP 2006-314839 published on Nov. 24, 2006.
English Language Translation of JP 2006-314839 published on Nov. 24, 2006.
English Language Abstract of JP 2006-314840 published on Nov. 24, 2006.
English Language Translation of JP 2006-314840 published on Nov. 24, 2006.
U.S. Appl. No. 12/094,937 as of Oct. 14, 2011.
English Language Translation of Chinese Office Action issued on Aug. 14, 2009 in CN Appl. 200680027088.
English Language Abstract of CN 1497091 published May 19, 2004.
Japanese Office Action issued in JP 2005-215959 on Mar. 8, 2011.
English Translation of Japanese Office Action issued in JP 2005-215959 on Mar. 8, 2011.
Concise Explanation of relevance of JP47-8921 published Apr. 5, 1972.
U.S. Appl. No. 11/996,677 as of Jun. 17, 2010 to Apr. 26, 2011.
U.S. Appl. No. 12/094,065 as of Jun. 17, 2010 to Apr. 26, 2011.
U.S. Appl. No. 12/094,937 as of Jun. 17, 2010 to Apr. 26, 2011.
English Language Abstract of DE 10255575 published Dec. 11, 2003.
German Office Action issued in DE 11 2006001946.5-26 on Apr. 1, 2011.
English Translation of German Office Action issued in DE 11 2006001946.5-26 on Apr. 1, 2011.
Office Action issued in JP Appl 2005-334367 on Mar. 8, 2011.
English Translation of Office Action issued in JP Appl 2005-334367 on Mar. 8, 2011.
U.S. Appl. No. 11/996,677 as of Apr. 26, 2010 to May 31, 2011.
Office Action issued in Japanese Appl 2005-045612 on Feb. 9, 2010.
English Translation of Office Action issued in Japanese Appl 2005-045612 on Feb. 9, 2010.
English Abstract of Japanese Publication No. H02-148697 on Dec. 18, 1990.
Chinese Office Action issued in corresponding Application No. 200680005481.9 mailed Mar. 6, 2009.
English translation of Chinese Office Action issued in corresponding Application No. 200680005481.9 mailed Mar. 6, 2009.
Notice of Submission of Argument issued on Mar. 16, 2009 in corresponding Korean patent application No. 7020455/2007.
English translation of Notice of Submission of Argument issued on Mar. 16, 2009 in corresponding Korean patent application No. 7020455/2007.
Machine English language translation of JP 2005-052533.
English Abstract of JP 2005-052533.
Machine English language translation of JP 2005-052534.
English Abstract of JP 2005-052534.
Machine English language translation of JP 2005-034163.
English Abstract of JP 2005-034163.
English Abstract of KR 2004-0100894.
Search Report from PCT/JP2006/313486 dated Aug. 8, 2006.
Search Report from PCT/JP2006/316870 dated Oct. 10, 2006.
English Abstract of JP-A-2000-225286 published Aug. 15, 2000.
English abstract of JP-A-H11-114273 published Apr. 27, 1999.
English abstract of JP-A-2005-46414 published Feb. 24, 2005.
Search Report from PCT/JP2006/320643 dated Dec. 5, 2006.
English abstract of JP-2005-224414A published Aug. 25, 2005.
English abstract of JP-2005-27734 published Feb. 3, 2005.
Office Action issued in CN Appl 200680042899.7 on Nov. 20, 2009.
English Abstract of CN 1231357 published Oct. 13, 1999.
English Translation of Office Action issued in CN Appl 200680042899.7 on Nov. 20, 2009.
Office Action issued in CN Appl. 200680027088 on Aug. 14, 2009.
English Abstract of JP 2005-318917A published Nov. 17, 2008.
Machine English Translation of JP 2005-318917A published Nov. 17, 2008.
Machine English Translation of JP 2000-225286 published Aug. 15, 2000.
Machine English Translation of JP 2005-224414 published Aug. 25, 2005.
Machine English Translation of JP H11-114273 published Apr. 27, 1999.
Machine English Translation of JP 2005-46414 published Feb. 24, 2005.
Machine English Translation of JP 2005-27734 published Feb. 3, 2005.
File History of U.S. Appl. No. 12/094,065.
File History of U.S. Appl. No. 11/996,677.
File History of U.S. Application 12/094,937.
Supplementary European Search Report issued in EP 06783099.2 on May 20, 2011.

U.S. Appl. No. 12/094,066.
English Language Abstract of DE 69922864 published Jun. 9, 2005.
United Kingdom Office Action issued in GB0716373.6 on Jul. 13, 2009.
English Language Abstract of JP 2005-27768 published Feb. 3, 2005.
English Language Abstract of JP 2004-135755 published May 13, 2005.
English Language Abstract of JP H06-335599 published Dec. 6, 1994.
English Language Abstract of JP 2004-337519 published Dec. 2, 2004.
English Language Abstract of JP 2004-135715 published May 13, 2004.
Machine Language Translation of JP 2005-27768 published Feb. 3, 2005.
Machine Language Translation of JP 2004-135755 published May 13, 2005.
Machine Language Translation of JP H06-335599 published Dec. 6, 1994.
Machine Language Translation of JP 2004-337519 published Dec. 2, 2004.
Machine Language Translation of JP 2004-135715 published May 13, 2004.
Office Action issued in CN Appl 200680042899.7 on May 21, 2012.
English Translation of Office Action issued in CN Appl 200680042899.7 on May 21, 2012.
U.S. Appl. No. 12/094,937.
Chinese Office Action issued in CN 200680027088 on Nov. 2, 2012.
English Language Translation of Chinese Office Action issued in CN 200680027088 on Nov. 2, 2012.
Chinese Office Action issued in CN 200680042899.7 on Dec. 5, 2012.
English Language Translation of Chinese Office Action issued in CN 200680042899.7 on Dec. 5, 2012.

DRUM TYPE WASHING-DRYING MACHINE

BACKGROUND

1. Technical Field

The present invention relates to a drum type washing-drying machine in which a heat pump mechanism is used to dry clothes in a drum.

2. Related Art

General drum type washing-drying machines are constructed so that a drum accommodating clothes is controlled to be rotated, thereby being capable of automatically carrying out steps of wash, rinse, dehydration and drying.

Furthermore, hot air is supplied into the drum in the drying step so that the clothes are dried.

Conventional drum type washing-drying machines are provided with an electric heater such as a sheathed heater or honeycomb heater serving as a heat source, whereby air is heated by the electric heater. Furthermore, the drum type washing-drying machine is provided with a heat exchanger which is adapted to dehumidify hot air which has already absorbed water from the clothes in the drum.

However, since the system of heating air by an electric heater consumes a large amount of energy, there is a possibility that the consumption of energy may result in a huge burden for a general household. A drum type washing-drying machine has therefore been suggested which employs a heat-pump mechanism to heat air. This type of drum type washing-drying machine is described, for example, in Japanese Laid-open Patent Application No. 2004-135715 (JP-2004-135715A).

The above-described heat pump mechanism comprises a construction circulating a refrigerant by a compressor into a condenser, capillary tube (throttle) and evaporator in this sequence. A hot-air circulation path is defined along an outer periphery of a water tub. The condenser and evaporator both constituting the heat pump mechanism are disposed in the circulation path. Hot air is then produced by heat exchange between air circulating through the circulation path and the condenser, whereby the hot air is dehumidified by the heat exchange with the evaporator.

However, when the aforesaid heat pump mechanism is employed, the hot air supplied into the drum unavoidably has a low temperature of about 60° C. or below, which temperature is approximately one half of a temperature in the use of an electric heater or lower. As a result, since the drying performance is lowered, a period of the drying step needs to be increased.

Furthermore, even a heat pump can exert substantially the same drying performance as achieved by an electric heater when a flow rate of recirculated air is rendered larger than in the use of an electric heater. For example, when a compressor has a cooling capacity of about 1500 W, a flow rate of circulating air needs to be set to about 3 $m^3$/min. This value is twice to three times larger than a flow rate of circulating air in the use of an electric heater.

In order that such a high flow rate as noted above may be ensured, the blowing capacity of a blower fan needs to be increased, by rendering the blower fan large-scaled or by increasing a rotational speed of the blower fan. However, the large-scaled blower fan would increase an installation space of the blower fan, whereupon the size of a whole washing machine would be increased. Increasing the rotational speed of the blower fan would result in an increase in an amount of noise due to rotation of the blower fan.

Furthermore, the circulation air flow has an air-flow resistance proportional to the square of the air-flow velocity.

Accordingly, the flow rate of the circulating air can be increased by increasing an area of the circulating air-flow path thereby lowering a mean flow velocity of circulating air. In this case, however, the circulating air-flow path is rendered larger, which results in an increase in the size of the whole washing machine.

SUMMARY

An object of the present invention is therefore to provide a drum type washing-drying machine which can reduce the air-flow resistance of a circulation path through which air is recirculated between a hot-air supply unit provided with a heat pump mechanism and a drum, thereby increasing the flow rate of circulating air.

The present invention provides a drum type washing-drying machine comprising a water tub elastically mounted in a washing machine body and having a front formed with an opening, a drum rotatably mounted in the water tub, an air supply opening and an air discharge opening both provided in the water tub, a circulation path having both ends connected to the air supply opening and the air discharge opening respectively, a heat pump mechanism including a condenser and an evaporator both disposed in the circulation path, the heat pump mechanism being disposed with the washing machine body on a side of the water tub generally opposite the air supply opening and the air discharge opening, a blower fan disposed in the circulation path to circulate air between the circulation path and the water tub, and plurality of branch paths provided between a part of the circulation path where the condenser is located and the air supply opening and/or extending in another part of the circulation path between the evaporator and the air discharge opening, wherein either the air supply opening or the air discharge opening is provided in an upper part of the front of the water tub; the circulation path includes a heat exchange section where the condenser and the evaporator are disposed so as to be located below the water tub; and the branch paths extend from either the air supply or the air discharge opening provided in the upper part of the front of the water tub, through a periphery of the opening of the front of the water tub to the heat exchange section.

A part of the circulation path is composed of a plurality of branch paths, whereby a flow path area is increased in the drum type washing-drying machine of the invention. Accordingly, an amount of air circulated is increased without rendering the blower large-scaled or increasing the rotational speed of the blower fan, whereupon the drying performance can be improved.

DETAILED DESCRIPTION

The present invention will be described in more detail with reference to the accompanying drawings.

Figure 1:
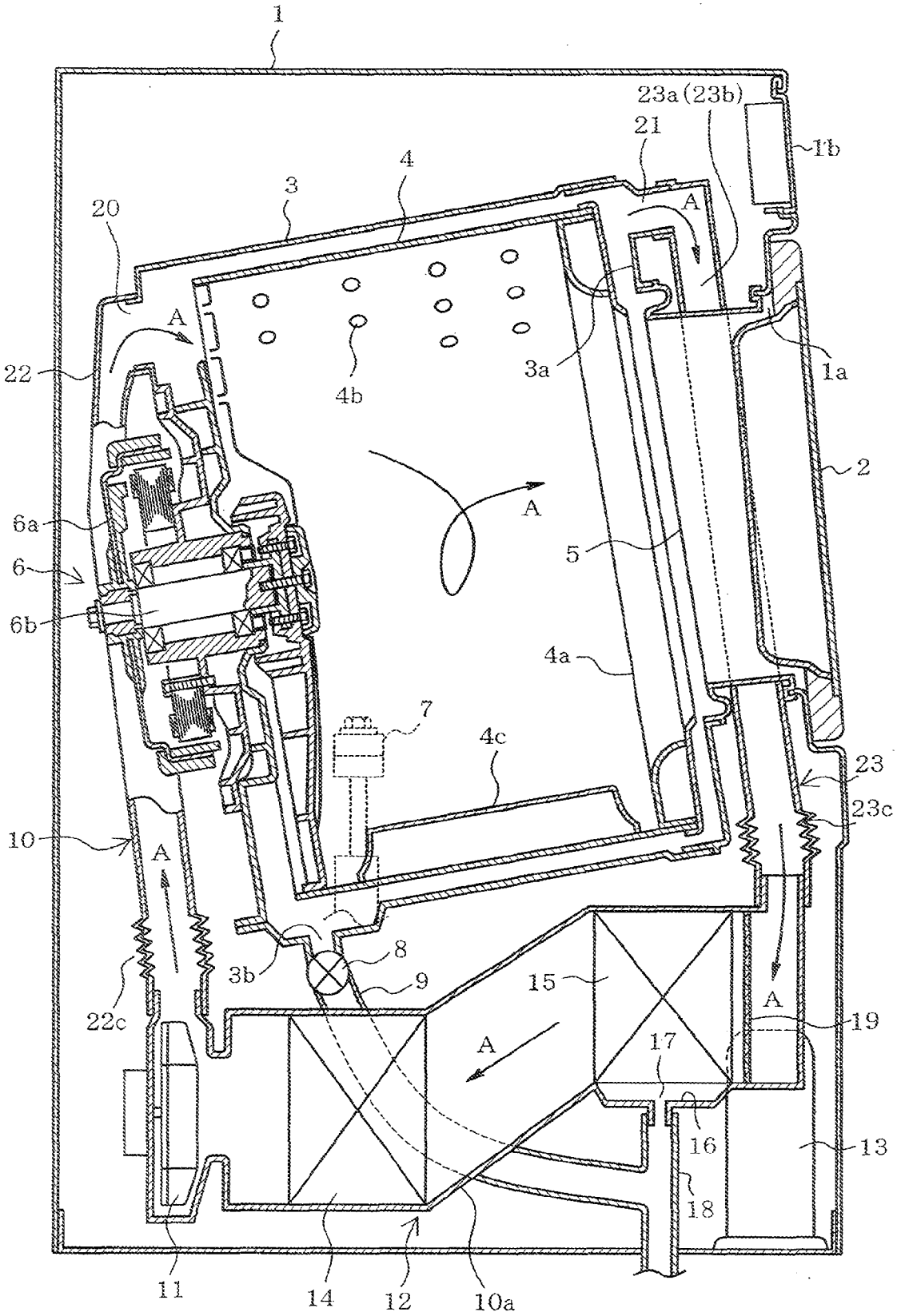
FIG. 1 is a longitudinal section of the drum type washing-drying machine of a first embodiment of the present invention, showing a schematic construction of the machine.
Figure 2:
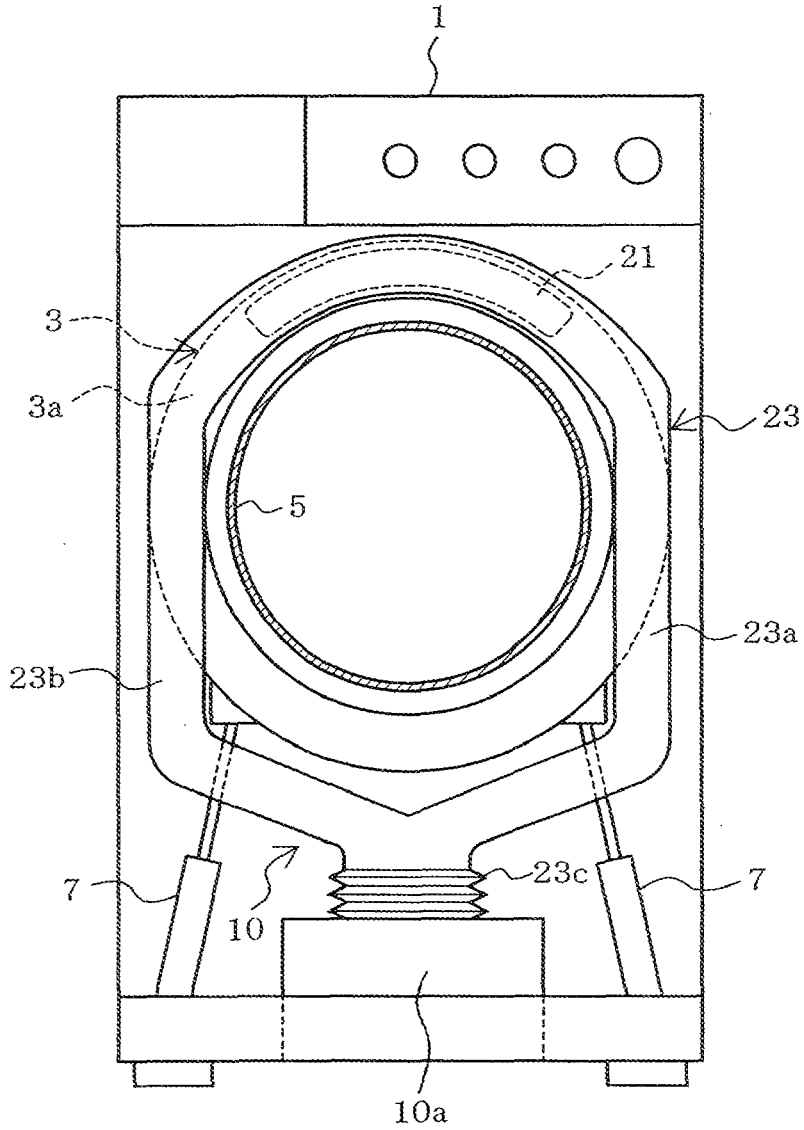
FIG. 2 is a schematic front view of the drum type washing-drying machine with a front panel of the body being removed.

FIGS. 1 and 2 illustrate a first embodiment of the invention. A body 1, which is an outer shell of a drum type washing-drying machine in accordance with the embodiment, is formed into the shape of a substantially rectangular box as shown in FIG. 1. The body 1 includes a central front provided with an access opening 1*a* through which clothes or the like is put into and taken out and a door 2 opening and closing the access opening 1*a*. A lower part of the access opening 1*a* is inclined slightly forward relative to an upper part thereof together with an upper half of the front of the body 1 according to an inclination of a drum 4 which will be described later. Furthermore, provided on the upper front of the body 1 is an operation panel 1*b* having operation knobs for input of washing conditions and the like.

A cylindrical water tub 3 is provided in the body 1. An annular tub cover 3*a* is attached to an opening of a front of the water tub 3. The water tub 3 is elastically supported by elastic supports 7 so as to be inclined diagonally forward. A cylindrical drum 4 is mounted in the water tub 3 so as to be rotatable about an inclined shaft which is inclined diagonally forward. The drum 4 has a front opening to which an annular balance ring 4*a* is attached. Furthermore, the drum 4 has a peripheral wall formed with a number of through holes 4*b*. A plurality of baffles 4*c* (only one being shown) are provided on an inner surface of the peripheral wall of the drum 4. The drum 4 serves as a wash tub, dehydration tub and drying tub.

The central openings of the tub cover 3*a* and balance ring 4*a* are opposed to the access opening 1*a* of the body 1. Hollow cylindrical elastic bellows 5 is connected between the access opening 1*a* and the tub cover 3*a* so as to communicate in a watertight manner. As a result, water can be prevented from leaking between the water tub 3 and body 1. Furthermore, clothes or the like can be put into and taken out of the drum 4 through the access opening 1*a*.

Furthermore, an electric motor 6 (hereinafter, "DD motor") directly driving the drum 4 is provided on a central rear of the water tub 3. The DD motor 6 comprises a DC brushless motor of the outer rotor type, for example. The DD motor 6 has a rotor 6*a* to which a rotational shaft 6*b* is directly connected. The rotational shaft 6*b* extends through a rear plate of the water tub 3, being connected to a central rear of the drum 4. Accordingly, when the DD motor 6 is energized to be driven, the drum 4 is rotated together with the rotor 6*a*.

A drain outlet 3*b* is formed in a lowermost rear part of the water tub 3. A drain pipe 9 is connected via a drain valve 8 to the drain outlet 3*b*. On the other hand, an air supply opening 20 and an air discharge opening 21 are formed on the upper rear and the upper front respectively. Both ends of a circulation path 10 are connected to the air supply opening 20 and the air discharge opening 21 respectively.

The circulation path 10 includes an air supply path 22 connecting a duct 10*a* (serving as a heat exchange section) located below the water tub 3, an air supply path 22 located in the rear of the water tub 3 for connecting the rear end of the duct 10*a* and the air supply opening 20 to each other, and an exhaust path 23 located in front of the water tub 3 for connecting the front end of the duct 10*a* and the air discharge opening 21 to each other.

An air blower fan 11 is provided in the rear interior of the duct 10*a*. A condenser 14 and an evaporator 15 both constituting a heat pump mechanism 12 are disposed in an upstream part of the air blower fan 11 in the interior of the duct 10*a* in turn from the rear.

The heat pump mechanism 12 includes a compressor 13 disposed on the front bottom of the body 1 and a capillary tube (throttle) which is not shown as well as the condenser 14 and the evaporator 15. Refrigerant fed out of the compressor 13 as the result of drive of the compressor is circulated through the condenser 14, capillary tube, evaporator 15 and compressor 13 sequentially in this order. Furthermore, the blowing action of the blower fan 11 circulates air through the circulation path 10, water tub 3 and drum 4 in the direction as shown by arrow A in FIG. 1. As a result, circulation air in the circulation path 10 is heated by heat exchange by the condenser 14 in the duct 10*a* thereby to be supplied from the air supply opening 20 into the water tub 3 and drum 4. On the other hand, air (hot air) supplied into the drum 4 depletes clothes or the like of fluid, thereafter flowing from the air discharge opening 21 into the circulation path 10 as shown in arrow A and then dehumidified by the heat exchange with the evaporator 15 in the duct 10*a*. Accordingly, the duct 10*a*, air blower fan 11, heat pump mechanism 12 and the like constitute a hot air supply unit which supplies hot air into the water tub 3 and drum 4.

A lint filter 19 for trapping lint is provided on an upstream art of the evaporator 15 in a front end interior of the duct 10*a*. Lint produced in a drying step and flowing into the circulation path 10 can be trapped by the filter 19 before reaching the evaporator 15. As a result, the dehydrating function can be prevented from being reduced due to the adherence of lint to finned tubing or the like, and flow of circulation air can be prevented from being blocked by the adherence of lint to finned tubing. The filter 19 is attachable to and detachable from the front or a side of the body 1 although the construction is not shown in detail. As a result, the filter 19 can be detached from the body 1 to be cleaned when clogged.

Furthermore, in response to the inclined drum 4, the duct 10*a* is constructed so that the front part thereof where the evaporator 15 is disposed is located higher than the rear thereof where the condenser is disposed. The bottom of the duct 10*a* has a recess 16 and drain outlet 17 both formed for collecting and draining dehydration fluid produced by heat exchange between the evaporator 15 and air. A dehydration fluid drain pipe 18 is connected to the drain outlet 17. The drain pipe 18 has a downstream end joining a downstream end of the wash liquid drain pipe 9, so that water flowing into the drain pipe 18 is adapted to be spontaneously drained outside the machine. In this case, since the air supply opening 20 and air discharge opening 21 are located at the upper part of the water tub 3, wash fluid or the like can be prevented from flowing into the circulation path.

A concrete construction of the circulation path 10 will now be described with reference to FIGS. 1 and 2. FIG. 2 is a schematic front view of the drum type washing-drying machine with a front plate of the body being removed. The air supply path 22 is disposed on a right part (a left part as viewed at the rear) of the motor 6 on the rear of the water tub 3, for example. The air supply path 22 has bellows 22*c* on a lower end thereof at which the path 22 is connected to duct 10*a*. A space is defined between the rear face of the body 1 and a portion of the rear of the water tub 3 other than the motor 6. The air supply path 22 is disposed utilizing the space in the embodiment. Accordingly, the body 1 need not be extended rearward since the air supply path 22 is disposed on the rear of the water tub 3.

On the other hand, the air discharge opening 21 is comprised of an arc-shaped opening which spreads right and left from the front ton of the water tub 3. The exhaust path 23 includes branch paths 23*a* and 23*b* diverging from air discharge opening 21 into right and left portions of the bellows 5 respectively and bellows 23*a* at lower end thereof at which the exhaust path 23 is connected to duct 10*a*. The branch paths 23*a* and 23*b* join together at the lower end of the exhaust path 23, communicating with the bellows 23*a*. A space is defined between the periphery of the bellows 5 and the front panel, of the body 1 in the front of the water tub 3. The branch paths 23*a* and 23*b* are disposed utilizing the space in the embodiment. Accordingly, the body 1 need not be extended frontward since the branch paths 23*a* and 23*b* are disposed in the front of the water tub 3.

The operation of the drum washing-drying machine will next be described. For example, when a standard washing-drying course starts, steps of wash, rinse, dehydration and drying are automatically carried out sequentially. In this case, the DD motor 6 is inverter-controlled so that the drum 4 is rotated at suitable rotational speeds.

Furthermore, the air blower fan 11 and the compressor 13 are driven in the drying step. As a result, air is circulated between the circulation path 10 and the water tub 3 and the drum 4. Furthermore, high-temperature high-pressure refrigerant flows from the compressor 13 into the condenser 14. After heat exchange has been carried out between the refrigerant and the circulation air in the circulation path 10 (duct 10*a*), the temperature of the refrigerant is decreased such that the refrigerant is liquefied. Thereafter, the refrigerant passes through the capillary tube and is subsequently decompressed, whereupon the refrigerant assumes a low-temperature low-pressure gas-liquid mixed state, flowing into the evaporator 15.

On the other hand, hot air due to the heat exchange with the condenser 14 flows through the exhaust path 23 by the blowing operation of the air blower fan 11, being supplied through the air supply opening 20 into the water tub 3 and the drum 4. After absorbing water content from clothes in the drum 4, the air is discharged from the air discharge opening 21, flowing through the exhaust path 23 into the duct 10*a*.

Air discharged out of the air discharge opening 21 is branched into the branch paths 23*a* and 23*b*. Thus, since the exhaust path 23 is composed of the branch paths 23*a* and 23*b*, the flow path area of the exhaust path 23 is substantially doubled. This increases a flow rate of air flowing from the air discharge opening 21 through the exhaust path 23 toward the duct 10*a* and accordingly a flow rate of whole circulated air.

Furthermore, air flowing through the branch paths 23*a* and 23*b* joins together, thereafter flowing into the duct 23*a*. Lint is eliminated from air when the air passes through the filter 19. Heat exchange is then carried out between the air and the evaporator 15 so that the air is dehumidified. Dehumidification fluid drops to be collected in the recess 16, thereafter being discharged from the outlet 17 through the drain pipe 18 out of the machine. Air dehumidified by the evaporator 15 flows to the condenser 14, where air is again rendered hot by heat exchange thereby to be supplied through the air supply path 22 and the air supply opening 20 into the drum 4. Air is thus circulated so that the clothes or the like in the drum 4 are dried.

According to the embodiment, the exhaust path 23 connecting the air discharge opening 21 and the duct 10*a* of the hot air circulation path 10 together is composed of two branch paths 23*a* and 23*b*. Accordingly, the flow path area of the exhaust path 23 can be increased to a large degree. As a result, even when the blower fan 11 having the same P-Q (static pressure-flow rate) characteristic as in the conventional construction is used, the flow rate of circulated air is reduced such that the flow path resistance is reduced, the flow rate of circulated air can be increased. Accordingly, even when the hot air supply is composed of the heat pump mechanism 12, a sufficient drying performance can be achieved and accordingly, the drying time need not be increased. Furthermore, since an amount of circulated air can be increased without increase in the size or rotational speed of the blower fan, noise can be prevented from being increased. Furthermore, only one filter 19 is required in the circulation path 10 since the filter 19 is disposed in the single path after joint of the branch paths 23*a* and 23*b*.

Figure 3:
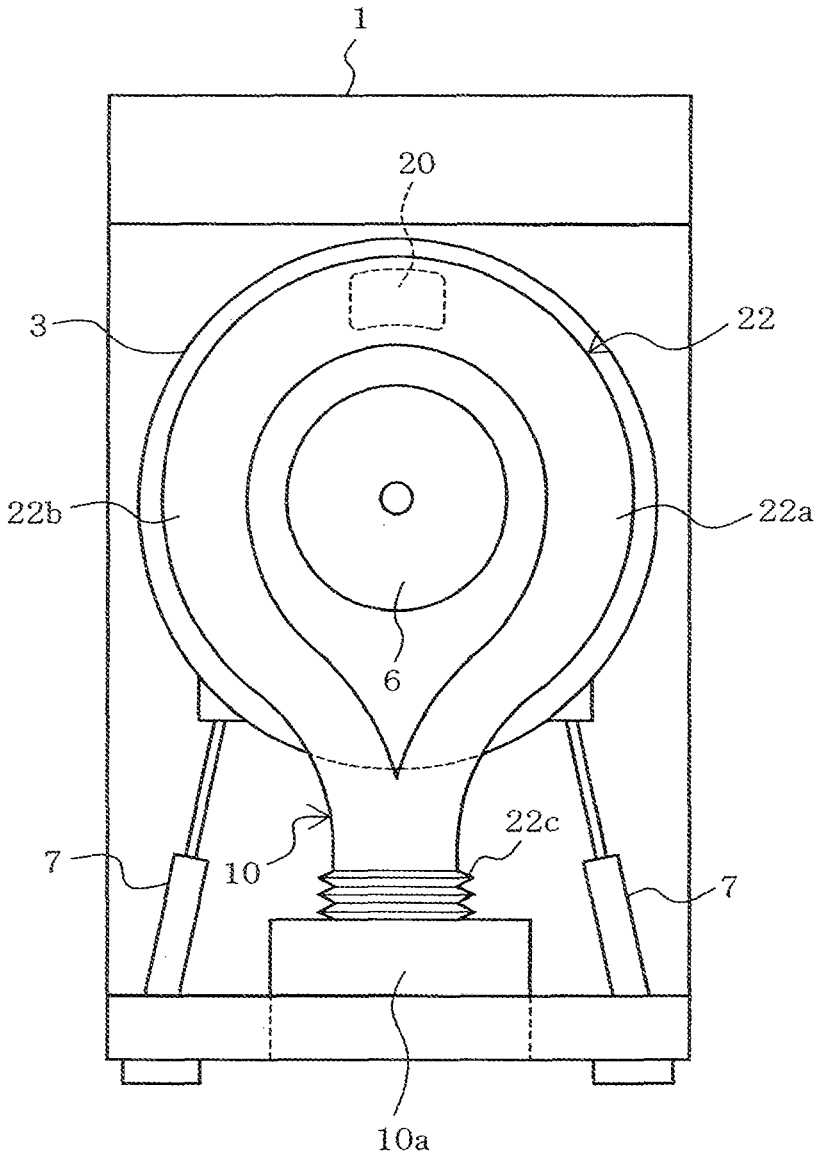
FIG. 3 is a schematic rear view of the drum type washing-drying machine of a second embodiment of the invention.

FIGS. 3 to 8 illustrate a second to sixth embodiments of the invention. The second to sixth embodiments will be described sequentially. FIG. 3 illustrates a second embodiment of the invention. FIG. 3 is a schematic rear view of the drum type washing-drying machine with the rear face of the body 1 being eliminated. The air supply path 22 is comprised of two branch paths 22*a* and 22*b* as shown in FIG. 3. The branch paths 22*a* and 22*b* are located in the left and right of the DD motor 6 in the rear of the water tub 2 respectively. The branch paths 22*a* and 22*b* join together at lower ends.

The DD motor 6 protrudes rearward relative to the rear face of the water tub 3. Accordingly, a space is defined between the rear face of the body 1 and a part of the rear face other than the DD motor 6. The space is utilized for the branch paths 22*a* and 22*b* in the embodiment. Thus, the branched air supply path 22 can suppress a rearward increase in the size of the body 1. The exhaust path 23 is comprised of a single path disposed in the right or left part of the bellows 5 in the front of the water tub 3 although the disposition is not shown.

According to the embodiment, the flow path area of the air supply path 22 can be increased since the air supply path 22 is comprised of the branch paths 22*a* and 22*b*. Accordingly, the flow rate of air circulating in the circulation path 10 can be increased without increase in the size of the blower fan 11 or increase in the rotational speed of the blower fan 11 as in the first embodiment. As a result, a sufficient drying performance can be achieved without increase in the drying time even when the hot air supply unit is composed of the heat pump mechanism 12.

Figure 4:
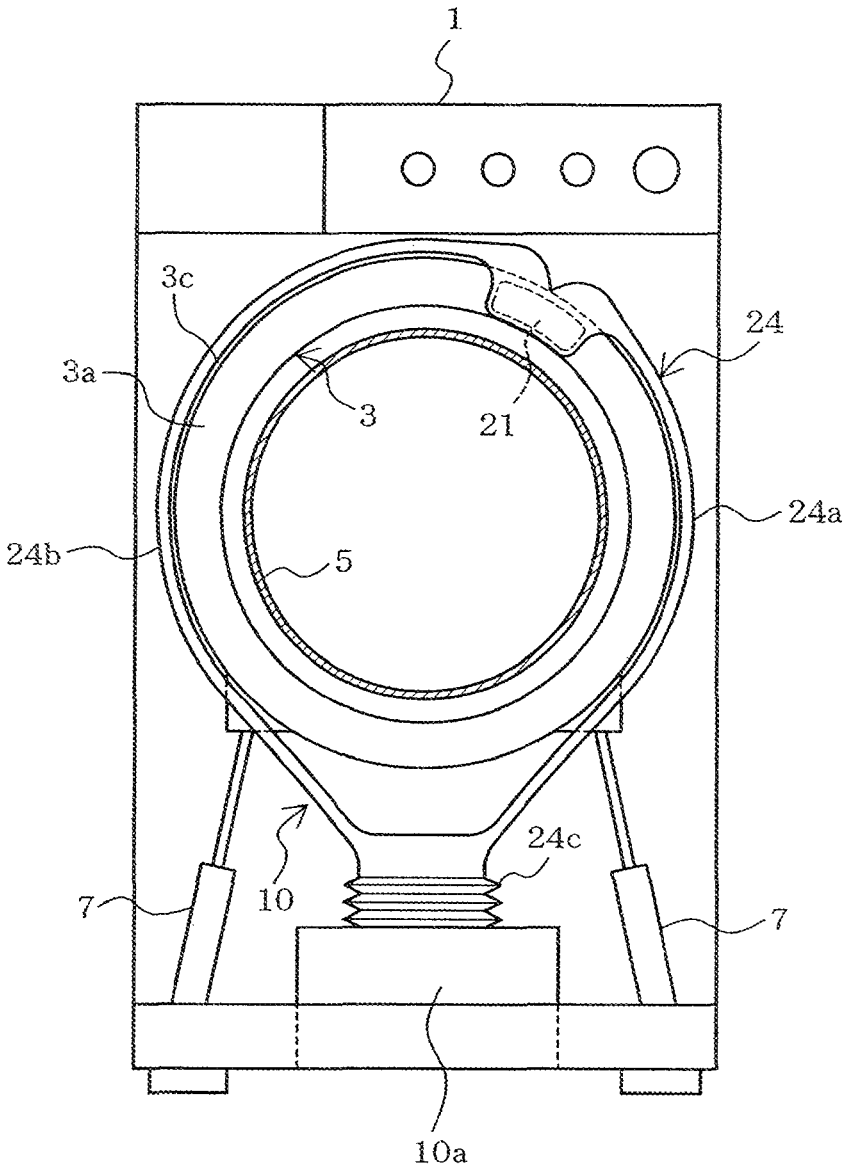
FIG. 4 is a view similar to FIG. 2, showing a third embodiment of the invention.

FIG. 4 illustrates a third embodiment of the invention. The following describes differences of the third embodiment from the first embodiment. In the third embodiment, the exhaust path 24 extends upwards from the air discharge opening 21 along the front face of the water tub 3 and is thereafter branched into the branch paths 24*a* and 24*b* both extending downward from a cylindrical body 3*c* of the water tub 3. The branch path 24*a* extends downward along the right part of the cylindrical body 3*c*, whereas the branch path 24*b* extends downward from the left part of the cylindrical body 3. The branch paths 24*a* and 24*b* join together at lower ends, thereafter being connected via the bellows 24*c* to the front end of the duct 10*a*.

Each of the branch paths 24*a* and 24*b* has a section configured into a flat rectangular shape and is constructed so as not to protrude so far axially with respect to the water tub 3 when disposed on the surface of the cylindrical body 3*c*. Furthermore, each branch path is made of elastic rubber, for example. Consequently, the branch paths 24*a* and 24*b* can be prevented from breakage or deformation even when the branch paths 24*a* and 24*b* are brought into contact with the body 1 upon oscillation or vibration of the water tub 3 during rotation of the drum 4.

Figure 5:
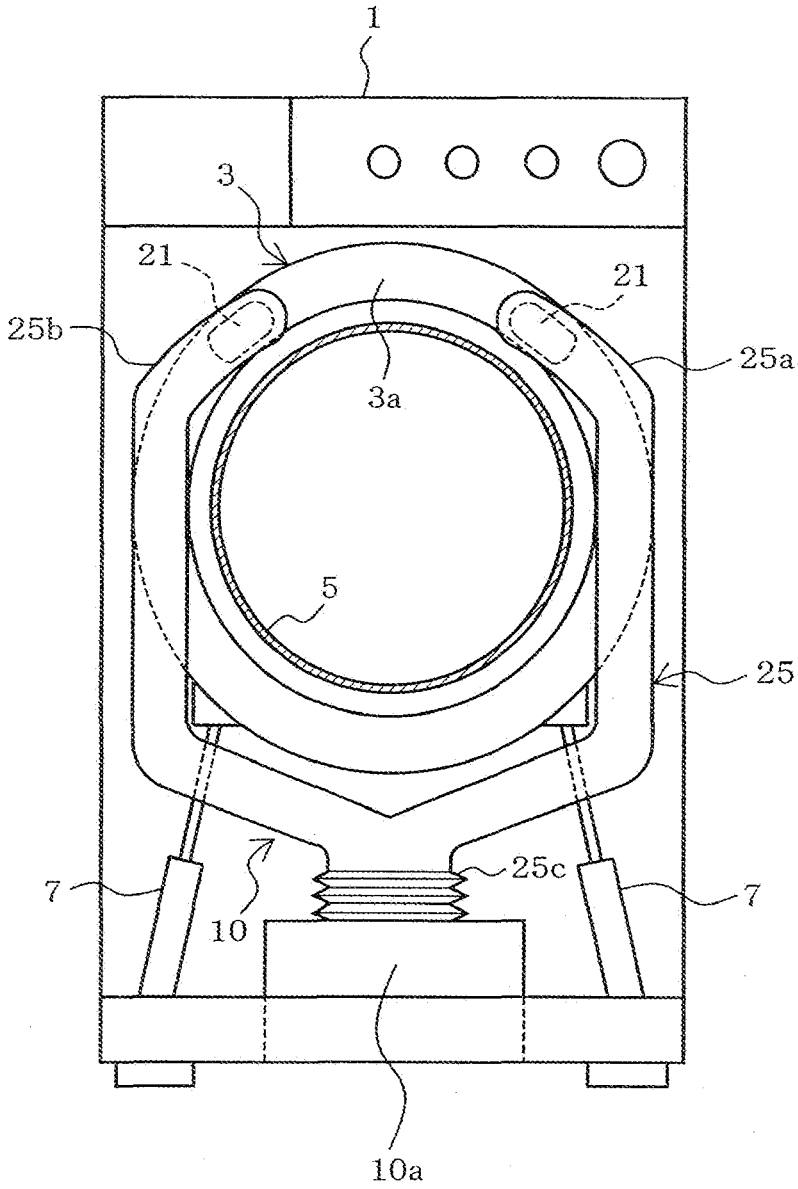
FIG. 5 is a view similar to FIG. 2, showing a fourth embodiment of the invention.

FIG. 5 illustrates a fourth embodiment of the invention. The following describes differences of the fourth embodiment from the first embodiment. In the fourth embodiment, one air discharge opening 21 is provided at each of portions displaced slightly rightward and leftward from the top of the front face of the water tub 3. These two air discharge openings 21 are disposed in the upper front of the water tub 3 so as to be spaced away from each other within such a range that there is no possibility of invasion of wash liquid or the like from the water tub 3. Furthermore, an exhaust path 25 includes a branch path 25*a* extending downward from the left air discharge opening 21 through the left part of the bellows 5 and a branch path 25*b* extending downward from the right air discharge opening 21 through the right part of the bellows 5. The branch paths 25*a* and 25*b* join together at the lower ends into a single path, which is connected through the bellows 25*c* to the front end of the duct 10*a*.

The above-described construction operates in the same manner as in the first embodiment and achieves the same effects as in the first embodiment. Furthermore, air in the water tub 3 and drum 4 can effectively be taken into the branch paths 25*a* and 25*b* as the result of provision of two air outlets 21 spaced away from each other. Moreover, since the two air outlets 21 are spaced away from each other, an addition of the lengths of the branch paths 25*a* and 25*b* can be rendered shorter than an addition of the lengths of the branch paths 23*a* and 23*b* in the first embodiment. A flow path resistance is proportional to the flow path length. Accordingly, the flow path resistance can further be reduced when the lengths of the branch paths 25*a* and 25*b* are shortened.

Figure 6:
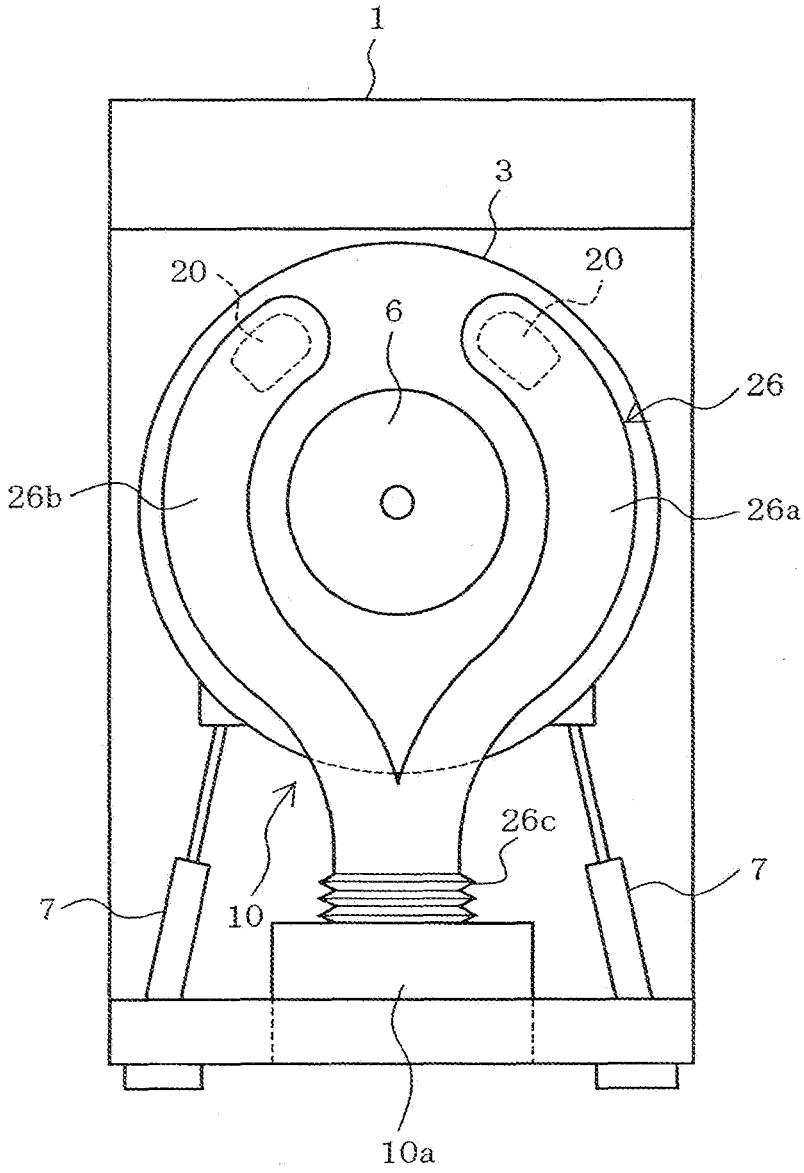
FIG. 6 is a view similar to FIG. 2, showing a fifth embodiment of the invention.

FIG. 6 illustrates a fifth embodiment of the invention. The following describes differences of the fifth embodiment from the second embodiment. In the fifth embodiment, one air supply opening 20 is provided at each of portions displaced slightly rightward and leftward from the top of the rear face of the water tub 3. These two air supply openings 20 are disposed in the upper rear of the water tub 3 so as to be spaced away from each other within such a range that there is no possibility of invasion of wash liquid or the like from the water tub 3. Furthermore, an exhaust path 26 includes a branch path 26*a* extending downward from the left (the right as viewed in FIG. 6) air supply opening 20 through the left part of the DD motor 6 and a branch path 26*b* extending downward from the right air supply opening 20 through the right part of the bellows S. The branch paths 26*a* and 26*b* join together at the lower ends into a single path, which is connected through the bellows 26*c* to the rear end of the duct 10*a*.

The above-described construction operates in the same manner as in the second embodiment and achieves the same effects as in the second embodiment since the flow path area of the air supply path 26 can be increased. Furthermore, dry air can quickly be taken into a wider range of interior of the drum 4 in the water tub 3 as the result of provision of two air discharge openings 21 spaced away from each other. Consequently, the drying performance can be improved. Furthermore, the flow length of the air supply path can be shortened such that the flow path resistance can be reduced, in the same manner as in the fourth embodiment.

Figure 7:
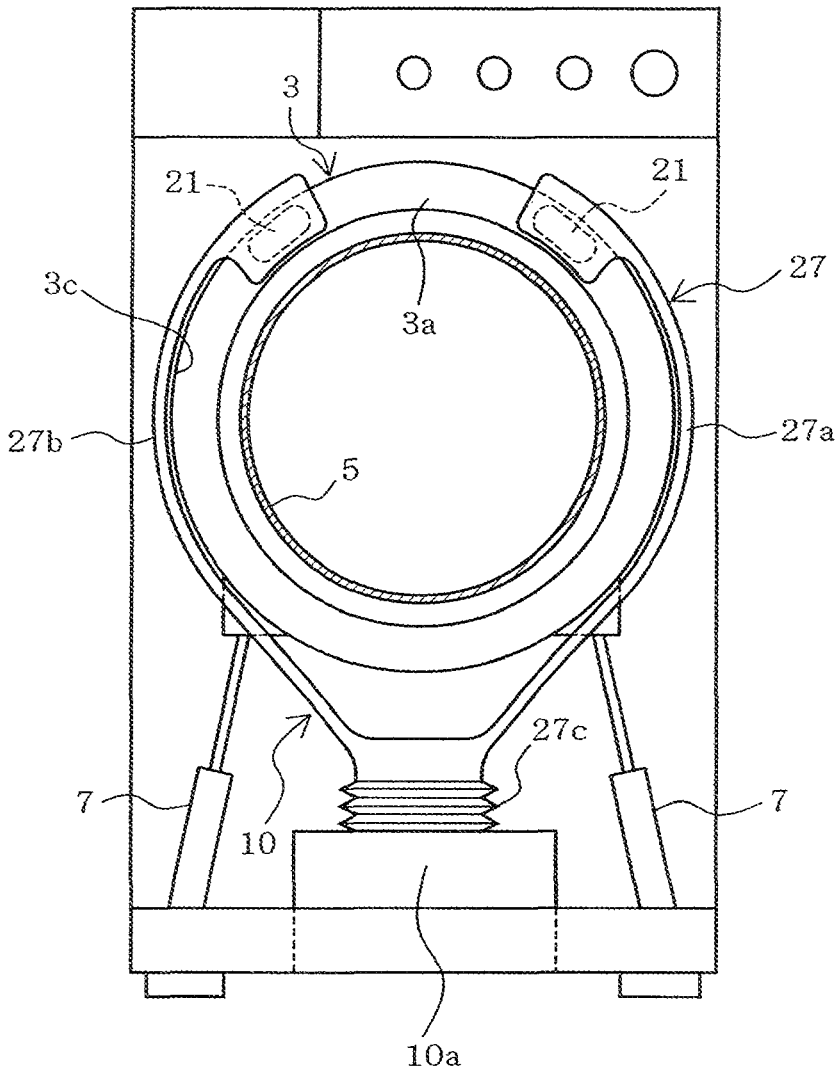
FIG. 7 is a view similar to FIG. 2, showing a sixth embodiment of the invention.

FIG. 7 illustrates a sixth embodiment of the invention. The following describes differences of the sixth embodiment from the second embodiment. The sixth embodiment has the characteristics obtained by combining the third embodiment (see FIG. 4) and the fourth embodiment (see FIG. 5). More specifically, the air discharge path 27 has a branch path 27*a* disposed along the right side of the cylindrical body 3*c* of the water tub 3 and a branch path 27*b* disposed along the left side of the body. The branch paths 27*a* and 27*b* join together at lower ends into a single path, which is connected via the bellows 27*c* to the front end of the duct 10*a*. Furthermore, one air discharge opening 21 is provided at each of portions displaced slightly rightward and leftward from the top of the front face of the water tub 3. The upper ends of the branch paths 27*a* and 27*b* are connected to these two air discharge openings 21 respectively. The branch paths 27*a* and 27*b* include portions which confront the body 3*c* and have flat rectangular sections respectively. The above-described construction operates in the same manner as in the third or fourth embodiment and achieves the same effects as in the third or fourth embodiment since the flow path area of the air supply path 26 can be increased.

Figure 8:
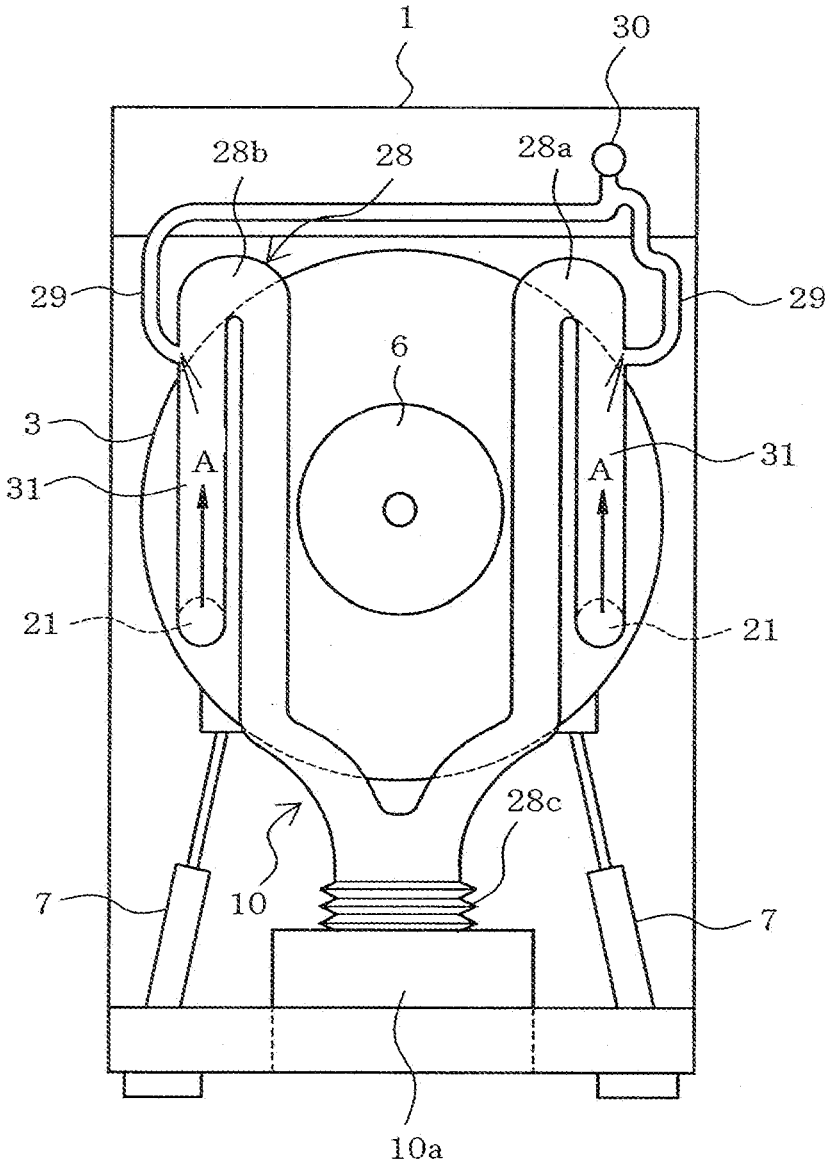
FIG. 8 is a view similar to FIG. 2, showing a seventh embodiment of the invention.

FIG. 8 illustrates a seventh embodiment of the invention. The following describes differences of the seventh embodiment from the second embodiment. In the seventh embodiment, one air discharge opening 21 is provided at each of right and left lower portions of the rear face of the water tub 3.

The branch paths 28*a* and 28*b* constituting the exhaust path 28 are disposed on the portions of the rear of the water tub 3 located on the right and left of the DD motor 6 respectively. The branch paths 28*a* and 28*b* join together at one ends or lower ends into a single path, which is connected via the bellows 28*c* to the rear end of the duct 10*a*.

The branch paths 28*a* and 28*b* have the other ends connected to the left and right air discharge openings 21 respectively. The branch paths 28*a* and 28*b* extend substantially vertically upwards from the respective air discharge openings 21 and are bent near the body 3*c* of the water tub 3 into a U shape in such a direction that both outlets come close to each other. The air discharge openings 21 thereafter extend downward. Furthermore, the branch paths 28*a* and 28*b* join together at lower ends into a single path, which is connected to the bellows 28*c*.

Portions of the branch paths 28*a* and 28*b* extending upright from the air discharge openings 21 serve as water-cooled heat exchangers 31 respectively. Water-supply pipes 29 have one ends connected to upper portions of the heat exchangers 31 respectively. The water-supply pipes 29 have the other ends connected to a water-supply valve 30. As the result of the above-described construction, cooling water from the water-supply valve 30 is supplied via the water-supply pipes 29 into the heat exchangers 31 respectively.

A single air supply opening is provided in the upper front of the water tub 3 although not shown. An air supply path is disposed in the front of the water tub 3. The air supply path has a lower end connected via the bellows to the front end of the duct. The condenser and evaporator are disposed in the front and rear interiors of the duct so as to correspond to the air supply opening and air discharge openings 21 respectively.

Air discharged from the air discharge openings 21 in the drying step flows upward in the heat exchanger 31 as shown by arrows A. In this case, the water-supply valve 30 is opened so that cooling water is sprinkled from the water-supply pipes 29 into the heat exchangers 31 respectively. As a result, the air flowing upward in the heat exchangers 31 is brought into contact with the cooling water such that water content in the air is cooled thereby to be condensed, dropping downward. Water having dropped (dehydration water) flows through the air discharge openings 21 into the water tub 3 thereby to be discharged from the drain outlet 3*b* (see FIG. 1) outside the machine.

Humidified air flows along the branch paths 28*a* and 28*b* and then join together, thereafter flowing through the bellows 28*c* into the duct 10*a*. Air having flowed into the duct 10*a* is dehumidified by heat exchange with the evaporator. The evaporator is supplementarily operated since the heat exchangers 31 are located above the evaporator. More specifically, an amount of dehumidification water produced by the evaporator is smaller than in the foregoing embodiments.

Air having passed through the evaporator 15 thereafter flows into the condenser 14, where the air is heated into dried air which is supplied into the drum 4. Clothes and the like in the drum 4 are dried by the above-described air circulation.

According to the embodiment, a part of the exhaust path 28 serves as the heat exchanger 31, the dehumidifying performance can be improved and accordingly, the drying performance can be improved.

Since the air discharge openings 21 are provided in the lower rear of the water tub 3 in the embodiment, wash liquid is easy to enter the heat exchangers 31 in the wash or rinse step. However, the heat exchangers 31 extend upward from the air discharge openings 21, and the upper ends of the heat exchangers 31 are located higher than the cylindrical portion 3*c* of the water tub 3. Accordingly, the wash liquid having entered the heat exchangers 31 through the air discharge openings 21 are prevented from flowing over the heat exchangers 31 to reach the duct 10*a* respectively.

Furthermore, there is a possibility that cooling water may be flung up by exhaust air flow thereby to enter the branch paths 28*a* and 28*b* at the duct 10*a* side. However, the flow rate of exhaust air is reduced by an increase in the flow path area due to provision of the branch paths 28*a* and 28*b*. Accordingly, it becomes difficult for the exhaust air to fling up the cooling air.

The present invention should not be limited by the embodiments described above with reference to the accompanying drawings but the embodiments may be modified as follows. The dehydration drain pipe 18 may be provided with a drain valve in order that reverse flow of water from the drain pipe 18 into the circulation path 10 may be coped with.

When the heat exchangers 31 are provided as in the seventh embodiment, the sizes of the condenser 14 and evaporator 15 may be reduced. It is considered that a sufficient drying performance can be achieved even in such construction. According to the construction, the size of the heat pump mechanism and furthermore, the size of the entire washing-drying machine can be reduced. Furthermore, when the heat exchangers 31 are provided, the dehumidifying performance can be improved accordingly. Hence, an auxiliary heater may be provided for improvement of heating performance separately from the heat pump mechanism 12. As the result of the construction, the drying efficiency can be improved to a large degree. Additionally, the heat exchanger 31 may be provided on only one of the branch paths.

The cross-sectional shape and length of each branch path may be suitably adjustable. The motor driving the drum may be provided with a gear transmission mechanism, for example. Furthermore, the rotational shaft of the drum may be coupled by a belt to the rotational shaft of the motor.

The foregoing description and drawings are merely illustrative of the principles of the present invention and are not to be construed in a limiting sense. Various changes and modifications will become apparent to those or ordinary skill in the art. All such changes and modifications are seen to fall within the scope of the invention as defined by the appended claims.

The invention claimed is:

1. A drum type washing-drying machine comprising:

a water tub elastically mounted in a washing machine body and having a front formed with an opening;

a drum rotatably mounted in the water tub;

an air supply opening and an air discharge opening both provided in the water tub;

a circulation path having opposite ends connected to the air supply opening and the air discharge opening respectively;

a heat pump mechanism including a condenser and an evaporator both disposed in the circulation path, the heat pump mechanism being disposed within the washing machine body on a side of the water tub generally opposite the air supply opening and the air discharge opening;

a blower fan disposed in the circulation path to circulate air between the circulation path and the water tub; and a plurality of branch paths disposed between the washing machine body and the water tub and extending in a part of the circulation path between the condenser and the air supply opening and/or extending in another part of the circulation path between the evaporator and the air discharge opening, wherein:

either the air supply opening or the air discharge opening is provided in an upper part of the front of the water tub;

the circulation path includes a heat exchange section where the condenser and the evaporator are disposed so as to be located below the water tub; and the plurality of branch paths extend from either the air supply or the air discharge opening provided in the upper part of the front of the water tub, through a periphery of the opening of the front of the water tub to the heat exchange section to bypass the water tub.

2. The drum type washing-drying machine according to claim 1, wherein:

at least one of the air supply opening and the air discharge opening includes a plurality of openings; and the branch paths have ends connected to the openings respectively.

* * * * *

UNITED STATES PATENT AND TRADEMARK OFFICE

CERTIFICATE OF CORRECTION

PATENT NO. : 8,490,437 B2
APPLICATION NO. : 11/816568
DATED : July 23, 2013
INVENTOR(S) : Kawabata et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1673 days.

Signed and Sealed this
Eighth Day of September, 2015

Michelle K. Lee

Michelle K. Lee
*Director of the United States Patent and Trademark Office*